US007384114B2

(12) United States Patent
Takanose et al.

(10) Patent No.: US 7,384,114 B2
(45) Date of Patent: Jun. 10, 2008

(54) INK JET RECORDING APPARATUS AND METHOD

(75) Inventors: Tomoka Takanose, Numazu (JP); Ryutaro Kusunoki, Mishima (JP)

(73) Assignee: Toshiba Tec Kabushiki Kaisha (JP)

( * ) Notice: Subject to any disclaimer, the term of this patent is extended or adjusted under 35 U.S.C. 154(b) by 67 days.

(21) Appl. No.: 11/511,672

(22) Filed: Aug. 29, 2006

(65) Prior Publication Data

US 2006/0284913 A1 Dec. 21, 2006

Related U.S. Application Data

(63) Continuation of application No. PCT/JP2005/010377, filed on Jun. 6, 2005.

(30) Foreign Application Priority Data

Jun. 10, 2004 (JP) ..... 2004-172522

(51) Int. Cl.
*B41J 2/205* (2006.01)

(52) U.S. Cl. ..... 347/15; 347/43

(58) Field of Classification Search ..... 347/14–15, 347/43

See application file for complete search history.

(56) References Cited

FOREIGN PATENT DOCUMENTS

| | | | |
|---|---|---|---|
| JP | 59-201864 | 11/1984 | |
| JP | 1235655 | * 9/1989 | ..... 347/43 |
| JP | 2001--347694 | 12/2001 | |
| JP | 2003-54013 | 2/2003 | |

OTHER PUBLICATIONS

International Preliminary Report on Patentability for PCT/JP2005/010377.
Communication from ISA re: PCT/JP2005/010377.

* cited by examiner

*Primary Examiner*—Thinh Nguyen
(74) *Attorney, Agent, or Firm*—Harness, Dickey & Pierce, P.L.C.

(57) ABSTRACT

By initially setting a tone value-drive signal relation in which an assumed ink jet volume determined from the number of times the jettings of ink droplets of a respective kind relative to a tone value does not monotonically increase, the actual jet ink volume is set to monotonically increase relative to the jet volume.

7 Claims, 8 Drawing Sheets

INK JET RECORDING APPARATUS AND METHOD

CROSS-REFERENCE TO RELATED APPLICATIONS

This is a Continuation Application of PCT Application No. PCT/JP2005/010377, filed Jun. 6, 2005, which was published under PCT Article 21(2) in Japanese.

This application is based upon and claims the benefit of priority from prior Japanese Patent Application No. 2004-172522, filed Jun. 10, 2004, the entire contents of which are incorporated herein by reference.

BACKGROUND OF THE INVENTION

1. Field of the Invention

The present invention relates to the ink jet recording of jetting ink droplets from a corresponding nozzle by deforming a pressure chamber by an actuator and, in particular, to an ink jet recording apparatus and method of performing tone recording by jetting a plurality of ink droplets from a corresponding nozzle.

2. Description of the Related Art

Patent Document 1 below discloses the technique of effecting multi-stage tone control by, while jetting a plurality of kinds of ink droplets from a corresponding nozzle communicating with a pressure chamber, controlling the number of times the jettings of various kinds of ink droplets and achieving an enhanced tone representation capability.

In this prior art technique, when an assumed jet volume corresponding to the tone value is given by the following expression $$\sum_{i=1}^{N} Vi \times Ki,$$

where N is the number of kinds of ink droplets, Vi is a jet volume corresponding to the singly jetting of an i-th number of kinds of ink droplets, and Ki is a number of times the jettings of the i-th number of kinds of ink droplets corresponding to a given tone value.

The assumed jet volume is monotonically increased relative to the tone value.

Patent Document 1: JPN PAT APPLN KOKAI PUBLICATION NO. 2001-347694.

BRIEF SUMMARY OF THE INVENTION

Although, in the prior art technique, the assumed jet volume is monotonically increased relative to the tone value, the actual jet volume does not at all times increase monotonically relative to the tone value. It is not possible to obtain a matching between the concentration of print image data and that of an actually printed image and fully achieve an enhanced tone representation capability. This involves a problem of a poor print quality.

This task will be explained in more detail below. The inventor of the present application examined, by tests, a relation of the tone value to the actual jet volume, by the use of drive waveforms S1 and S2 in FIG. 8, while jetting small and large ink droplets. In this case, the number of times the respective jettings of the small and large ink droplets were so set that, the greater the tone value, the greater the assumed jet volume. As a result, Table 1 below was obtained. Here, the respective volume is represented as a ratio to the volume of a large ink droplet jetted. Further, the drive waveforms corresponding to the tones 1 to 7 are represented as shown in FIGS. 8A to 8G. From a result of Table 1 it is understood that the actual jet volume does not monotonically increase relative to the tone value in the case of the tone levels 3 and 4 and the tone levels 5 and 6.

TABLE 1

| Tone value | Small ink droplet | Large ink droplet | Assumed jet volume | Actual jet volume |
|---|---|---|---|---|
| 0 | 0 | 0 | 0 | 0 |
| 1 | 1 | 0 | 0.6 | 0.6 |
| 2 | 0 | 1 | 1 | 1 |
| 3 | 1 | 1 | 1.6 | 2.6 |
| 4 | 0 | 2 | 2 | 2.1 |
| 5 | 1 | 2 | 2.6 | 4.1 |
| 6 | 0 | 3 | 3 | 3.7 |
| 7 | 1 | 3 | 3.6 | 5.3 |

As shown in Table 1, the reason why the actual jet volume does not monotonically increase relative to the tone value is understood from the assumption that, when the large ink droplet is jetted after the jetting of the small ink droplet, the volume of the large ink droplet is increased due to an influence from the jetting action of the small ink droplet.

The present invention provides an ink jet recording apparatus and method which can assure a monotonical increase of an ink jet volume according to an increase of a tone value and ensure a better tone level recording.

In order to solve the above-mentioned task, the present invention provides an ink jet recording apparatus comprising an ink jet head having a pressure chamber with an ink held therein, an ink jet nozzle communicating with the pressure chamber, and an actuator configured to deform the pressure chamber according to a drive signal; translating means for allowing a tone value corresponding to the concentration of a print pixel to be translated to a pattern which controls the number of times the jetting of each of a plurality of kinds of ink droplet sizes, said translating means having a plurality of patterns corresponding to each tone value; and drive signal generating means for generating a drive signal for allowing the pressure chamber to be deformed by an actuator based on the pattern and an ink droplet of said plurality of kinds of ink droplet sizes to be jetted from the nozzle, characterized in that, when an assumed jet volume of said pattern is given by the following expression $$\sum_{i=1}^{N} Vi \times Ki$$

where N is the number of kinds of ink droplets, Vi is a jet volume corresponding to the singly jetting of the ink droplet in the i-th number of kinds of ink droplet sizes, and Ki is the number of times the jetting of ink droplets in the i-th number of kinds of ink droplet sizes according to the pattern.

The concentration of the pixel corresponding to a first tone value is set smaller than that of the pixel corresponding to a second tone value following the first tone value and an assumed jet volume of a pattern corresponding to the first tone value is set greater than that of a pattern corresponding to the second tone value.

DETAILED DESCRIPTION OF THE INVENTION

An embodiment of the present invention will be explained below with reference to the drawings.

Figure 1:
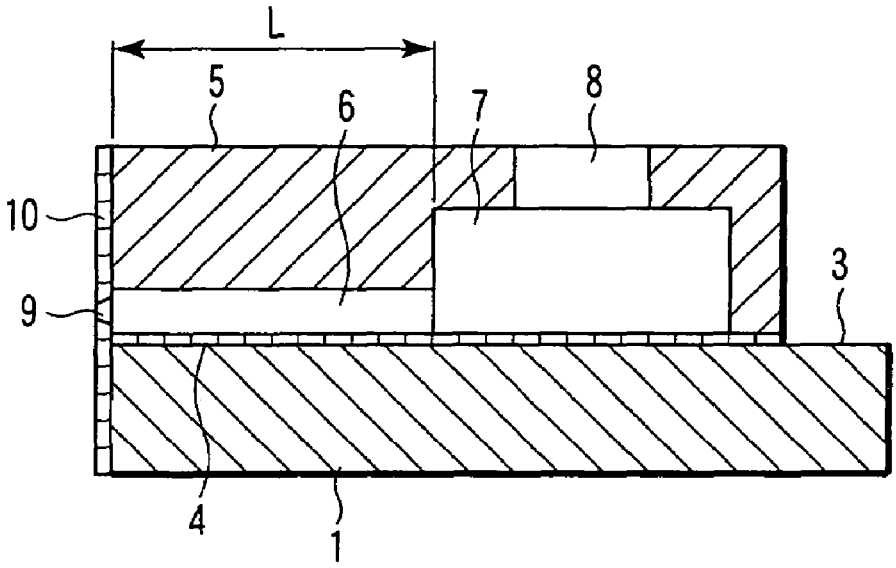
FIG. 1 is a longitudinal cross-sectional view showing a structure of an ink jet head for use in an ink jet recoding apparatus according an embodiment of the present invention.
Figure 2:
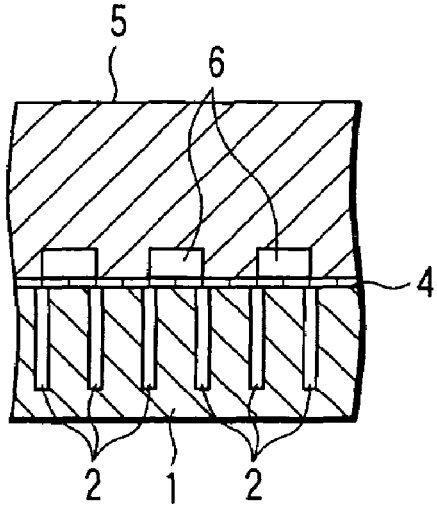
FIG. 2 is a partial cross-sectional view showing a structure of an ink jet head for use in the ink jet recording apparatus according to the embodiment.

FIG. 1 is a longitudinal, cross-sectional view showing a structure of an ink jet head for use in an ink jet recording apparatus. FIG. 2 is a partial, cross-sectional view showing the ink jet head for use in the ink jet recording apparatus.

A plurality of elongate grooves 2 are provided at predetermined intervals in the longitudinal direction in an actuator member 1 comprised of a piezoelectric member. An electrode 3 is provided between groove 2 and groove 2 in a surface of the actuator member 1 with a vibration plate 4 adhesively fixed on each electrode 3.

A plurality of elongate grooves 6 are provided at predetermined intervals in an lower surface of a top plate 5. The top plate 5 is adhesively fixed on the vibration plate 4. A pressure chamber 6 is defined between the inner surface of each groove and the vibration plate 4. Each pressure chamber 6 is so defined as to be arranged in an alternate array on an opposite side relative to the groove-to-groove portion of the actuator member 1.

An ink supply passage 7 is formed in the top plate 5 behind the respective pressure chamber 6 to allow fluid communication to be created there. An ink is supplied into the ink supply passage 7 from an outside via an ink supply inlet 8. A nozzle plate 10 is adhesively fixed to the forward ends of the actuator member 1 and top plate 5 such that a nozzle 9 is provided opposite the position of the respective pressure chamber 6.

The actuator member 1 is expanded/contracted by a drive signal applied to the electrode 3 to allow a volume in the pressure chamber 6 to vary through the vibration plate 4. The ink is passed from the ink supply inlet 8 and filled into the pressure chamber 6 through the ink supply passage 7. When the volume of the pressure chamber 6 is varied by the drive signal, an ink pressure is varied to allow an ink droplet to be jetted out of the nozzle 9.

Figure 3:
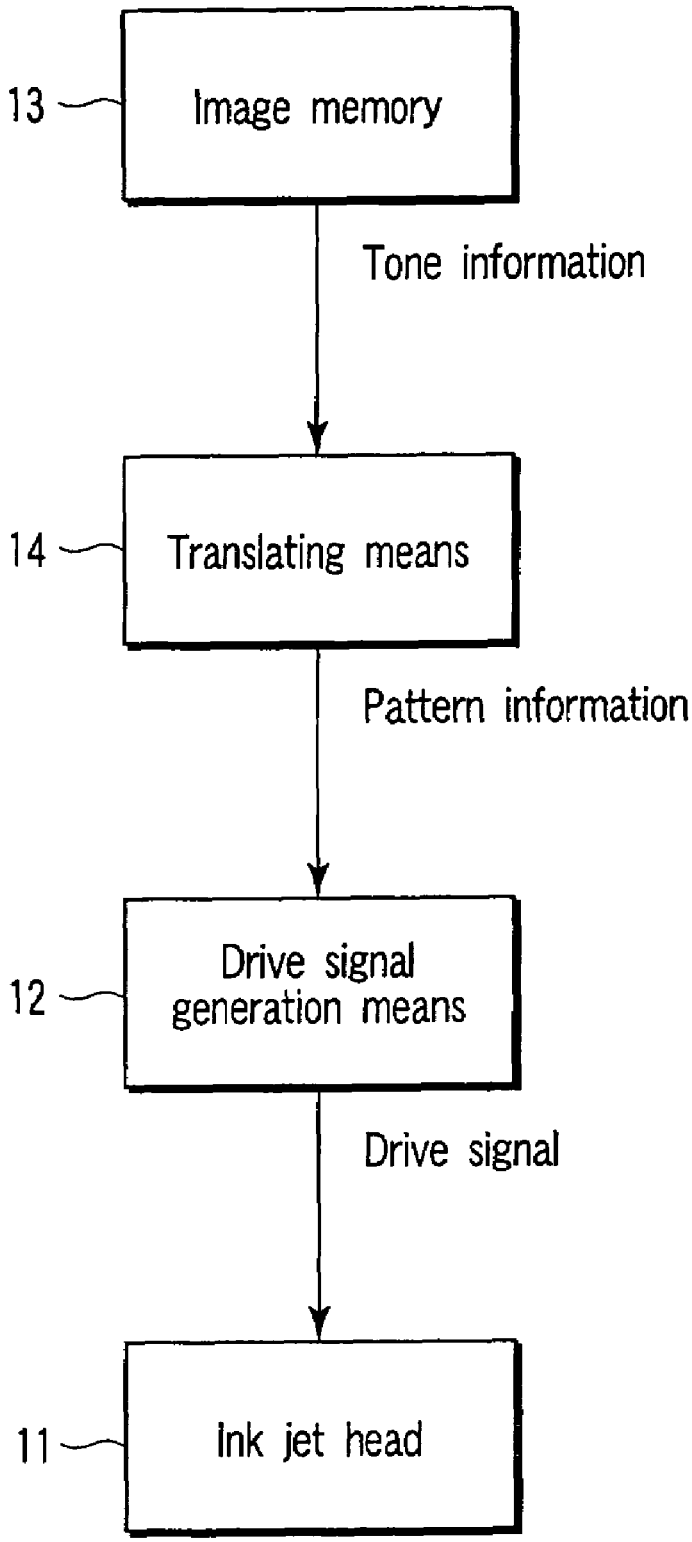
FIG. 3 is a block diagram showing an arrangement of an electric circuit of an ink jet recording apparatus according to the embodiment.

FIG. 3 is a block diagram showing an arrangement of an associated electric circuit. A translating means 14 allows a tone value corresponding to a concentration of each pixel of image data, that is, image data stored in an image memory 13, to be translated to a pattern for controlling the number of times each small ink drop and each large ink drop are jetted. A drive signal generating means 12 generates a drive signal based on the pattern from the translating means and supplies the drive signal to the ink jet head 11 of a structure as shown in FIGS. 1 and 2.

Table 2 shows the number of times the jettings of small and large ink droplets of a pattern corresponding to a respective tone value possessed by the translating means 14, an assumed jet volume of respective tone value and a result of measurements of an actual jet volume of respective tone value.

Here, when, for a given pattern, N represents the number of kinds of ink droplet sizes; Vi, a jet volume corresponding to a singly jetting of an i-th number of kinds of ink droplets; and Ki, a number of times corresponding to jetting of the i-th number of kinds of ink droplets, then the assumed jet volume is defined by the following expression:

$$\sum_{i=1}^{N} Vi \times Ki.$$

In the embodiment, N=2 and the present invention is not restricted to the number 2 of kinds of ink droplet sizes and use may be made of 3 or more number of ink droplet sizes. The assumed and actual jet volumes in Table 2 are indicated as a ratio at a time when the jet volume corresponding to the singly jetting of the kind of one large ink is unit. FIGS. 6A to 6G show drive signals corresponding to the respective tone values 1 to 7. Further, the tone value is so defined that the greater the pixel concentration of a print image the greater the tone value.

As shown in Table 2, the assumed jet volume corresponding to a pattern of a tone value 3 is greater than that corresponding to a following tone value 4. Further, the assumed jet volume corresponding to a pattern of the tone value 5 is greater than that corresponding to a pattern of a tone value 6.

That is, the translating means 14 is so set that, if the tone values 3 and 4 are set as the first and second values, respectively, or the tone values 5 and 6 are set as the first and second values, respectively, the assumed jet volume of a pattern corresponding to the first tone value becomes greater than the assumed jet volume of a pattern corresponding to the second tone value following the first tone value.

Further, the number of ink droplets jetted with the use of the first tone value is the same as that jetted with the use of the second tone value.

In the prior art technique, a tone value-drive signal relation was so set as to allow the assumed jet volume to increase monotonically relative to the tone value and, as a result, the actual jet volume did not increase monotonically relative to the tone value, presenting a problem. According to the present invention, a tone value-drive signal relation is so set beforehand as to prevent an assumed jet volume from monotonically increasing relative to the tone value. By doing so, the actual jet volume increases monotonically relative to the tone value.

Figure 7:
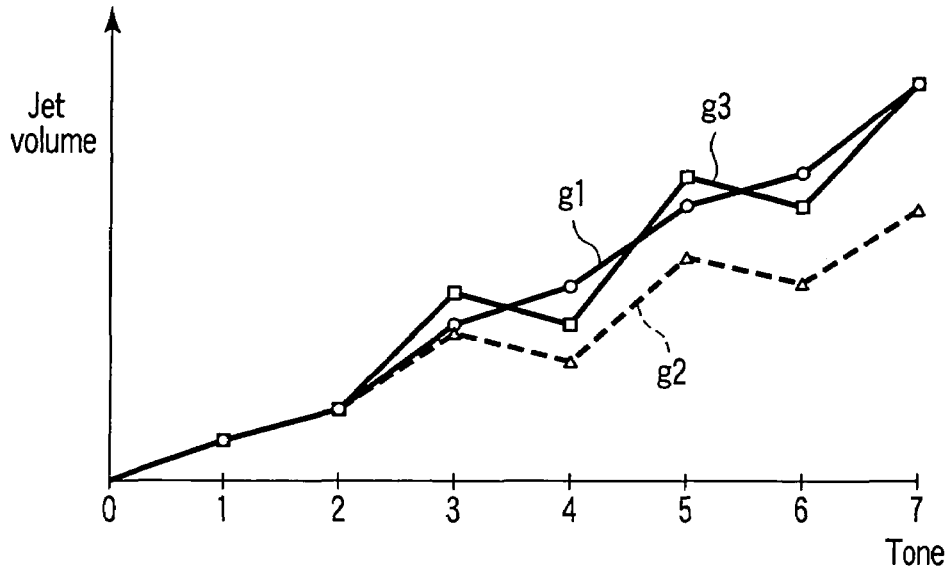
FIG. 7 is a comparative graph showing a tone signal-to-ink jet volume relation in the prior art and in the embodiment.
Figure 8A:
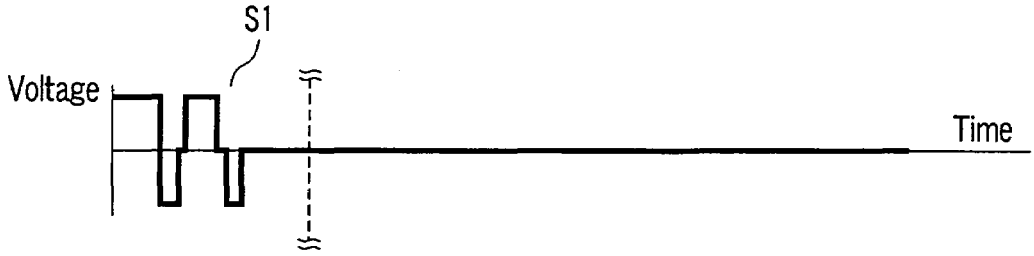
FIG. 8A is a view showing a drive signal of a tone value in the prior art.
Figure 8B:
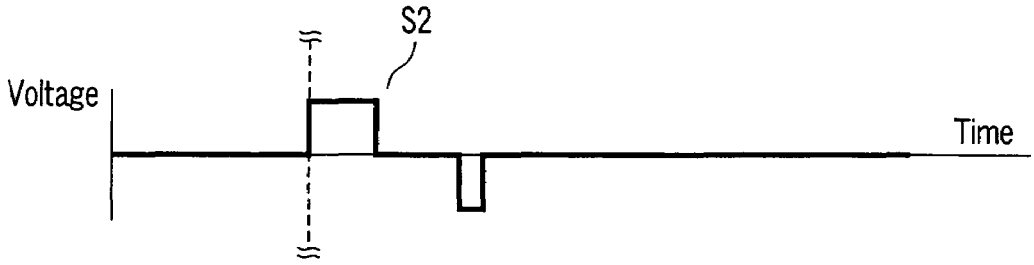
FIG. 8B is a view showing a drive signal of a tone value in the prior art.
Figure 8C:
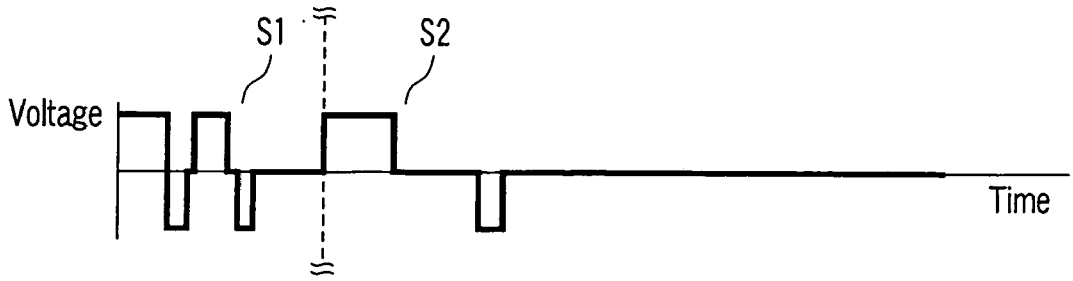
FIG. 8C is a view showing a drive signal of a tone value in the prior art.
Figure 8D:
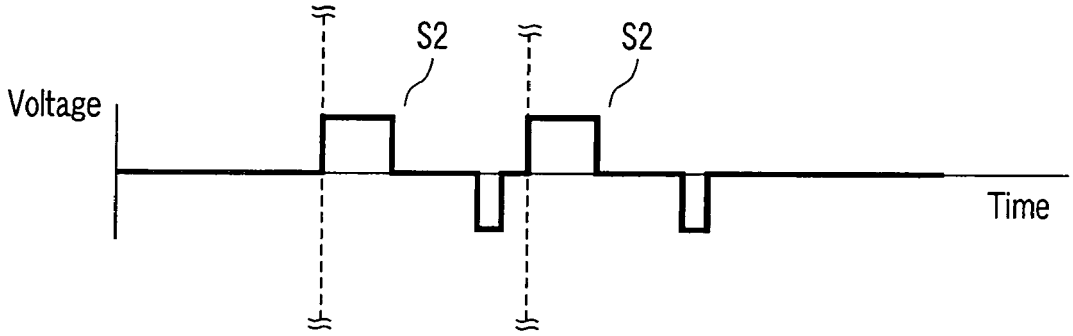
FIG. 8D is a view showing a drive signal of a tone value in the prior art.
Figure 8E:
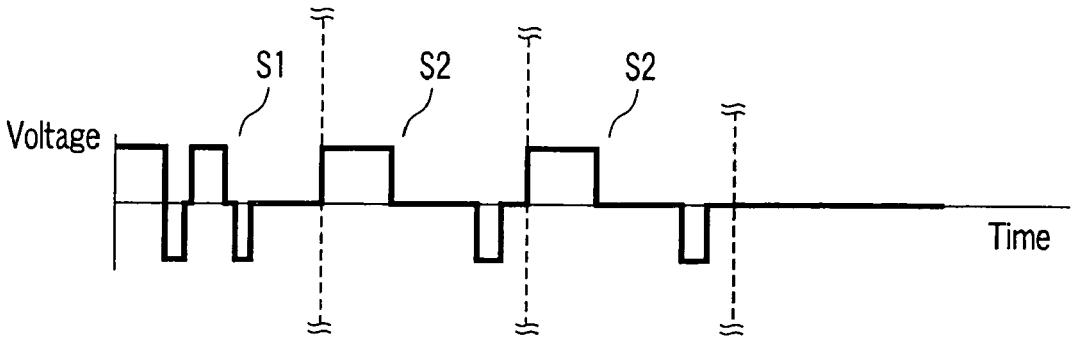
FIG. 8E is a view showing a drive signal of a tone value in the prior art.
Figure 8F:
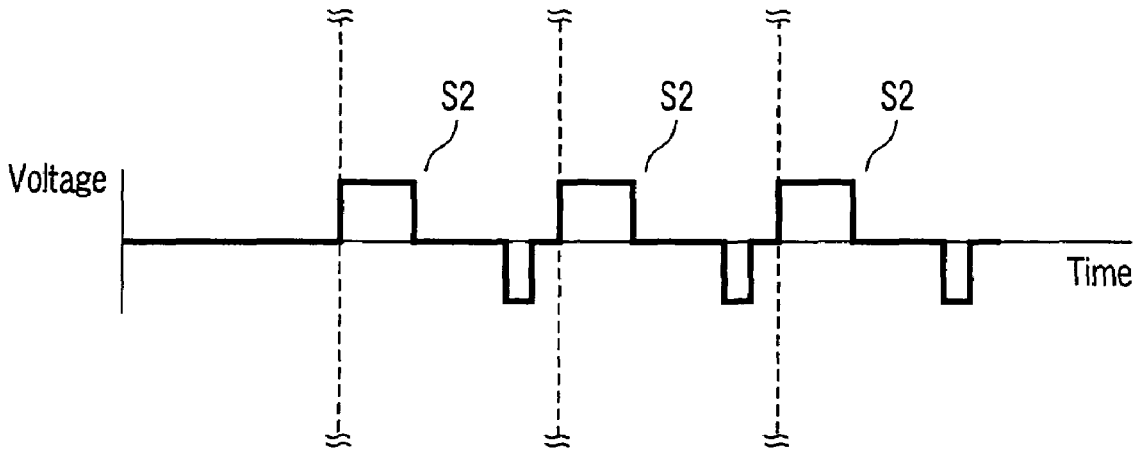
FIG. 8F is a view showing a drive signal of a tone value in the prior art.
Figure 8G:
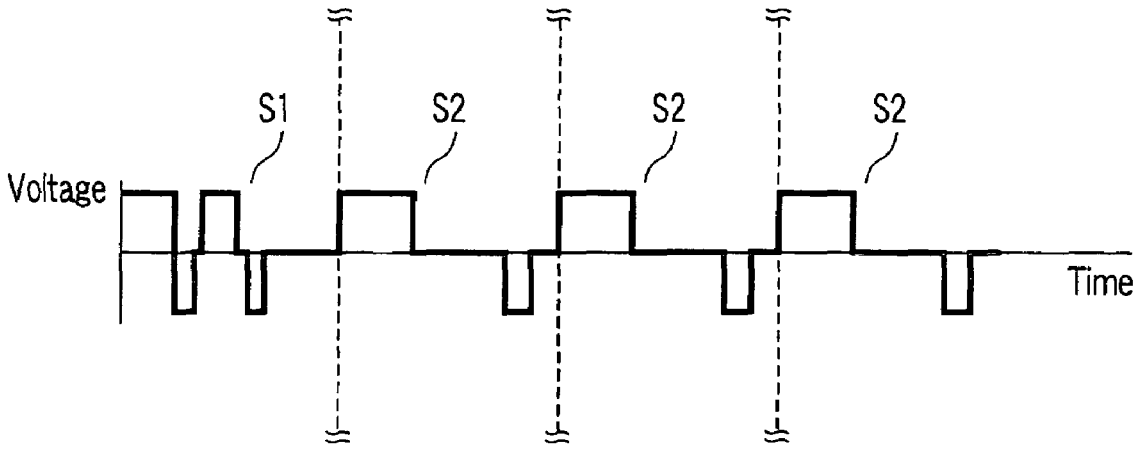
FIG. 8G is a view showing a drive signal of a tone value in the prior art.

FIG. 7 is a graph showing a result of Table 2. The graph g1 shows a relation between the tone value and the actual jet volume in the present embodiment. The graph g2 shows a relation between the tone value and the assumed jet volume in the present embodiment. The graph g3 shows a relation between the tone value and the actual jet volume in the prior art technique.

From FIG. 7 it can be understood that the jet volume monotonically increases relative to the tone value by the setting of the translating means. According to the present invention, therefore, it is possible to obtain a matching between the concentration of the print image data and the concentration of the actual printing image and fully achieve an enhanced tone representation capability under multi-stage tone control. It is thus possible to provide an ink jet recording apparatus excellent in printing quality.

TABLE 2

| Tone value | Small ink droplet | Large ink droplet | Assumed jet volume | Actual jet volume |
|---|---|---|---|---|
| 0 | 0 | 0 | 0 | 0 |
| 1 | 1 | 0 | 0.6 | 0.6 |
| 2 | 0 | 1 | 1 | 1 |
| 3 | 0 | 2 | 2 | 2.1 |
| 4 | 1 | 1 | 1.6 | 2.6 |
| 5 | 0 | 3 | 3 | 3.7 |
| 6 | 1 | 2 | 2.6 | 4.1 |
| 7 | 1 | 3 | 3.6 | 5.3 |

Figure 4:
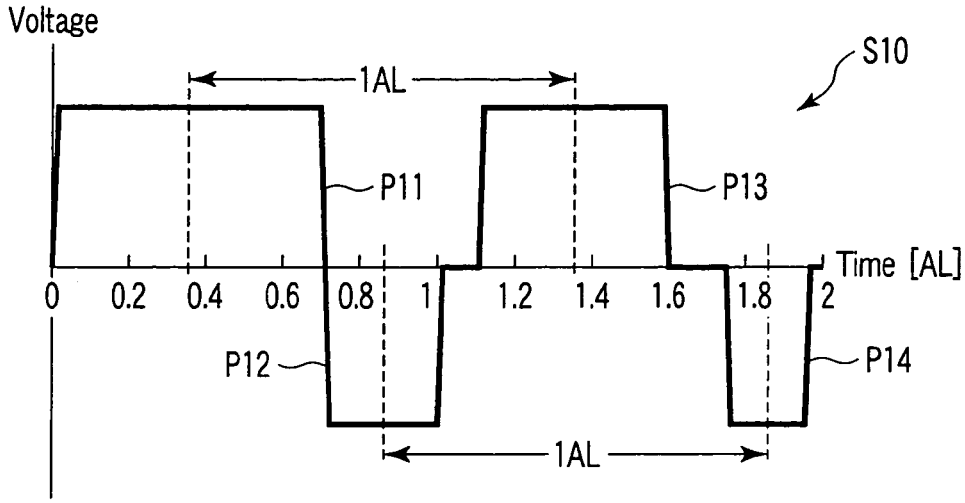
FIG. 4 is a view showing a drive signal waveform for jetting a small ink droplet in the ink jet recording apparatus according to the embodiment.

FIG. 4 shows a waveform of a drive signal S10 for jetting a small ink droplet from the nozzle 9. The drive signal S10 above comprises a first pulse P11 for expanding the volume of the pressure chamber 6, a second pulse P12 for contracting the volume of the pressure chamber 6, a third pulse P13 for again expanding the volume of the pressure chamber 6, and a fourth pulse P14 for again compressing the volume of the pressure chamber 6, these four pulses being rectangular in shape and being used to jet one small ink droplet.

The time difference between the center of the width of the first pulse P11 and the center of the width of the third pulse P13 is set to be 1 AL. Here, the 1 AL represents ½ of a natural vibration period of an ink pressure in the pressure chamber 6. And the time difference between the center of the width of the second pulse P12 and the center of the width of the fourth pulse P14 is similarly set to be 1 AL.

The AL can be found by measuring an impedance of the actuator member 1 of the ink jet head 11 filled with an ink by virtue of a commercially available impedance analyzer and using a frequency at which an impedance of the actuator member 1 falls due to a resonance in an ink in the pressure chamber 6. Further, it can also be found by measuring a voltage induced in the actuator member 1 caused by an ink pressure vibration and examining the vibration frequency of its voltage with the use of a synchroscope, etc.

The ratio of the width of the third pulse P13 to the width of the first pulse P11 corresponds to a value determined according to a damping factor of a residual vibration in an ink in the pressure chamber 6. Here, the ratio is set to be 0.7. The ratio of the width of the fourth pulse P14 to the width of the second pulse P12 is also set to be 0.7. It is to be noted that the damping factor of the residual vibration in the ink in the pressure chamber 6 is an inherent value determined by the passage of the ink head, the nozzle dimension and the physical property of the ink.

With the time difference of the center of the width of the first pulse P11 and the center of the width of the third pulse P13 set to be 1 AL, a relation between the phase of the pressure vibration generated by the first pulse P11 and the phase of the pressure vibration generated by the third pulse P13 is a mutually inverted state. Further, with the ratio of the width of the third pulse P13 to the width of the first pulse P11 set according to the damping factor of the residual vibration in the ink in the pressure chamber 6, it is possible to set the amplitude of the pressure vibration generated by the third pulse P13 to be equal to the amplitude of the residual vibration generated by the first pulse P11. By doing so, the pressure vibration generated by the first pulse P11 is almost cancelled by the third pulse P13. Further, the pressure vibration generated by the second pulse P12 is almost cancelled by the fourth pulse P14 on the same principle.

With the sum of the width of the first pulse P11 and width of the second pulse P12 held to an almost 1 AL and the widths of the first and second pulses P11 and P12 set shorter and longer, respectively, a meniscus back amount before the ink jetting decreases, and the jetting volume of the ink droplet can increases. Note that the meniscus is the interface where the ink in the nozzle contacts the atmosphere. If the with of the first pulse P11 and the width of the second pulse P12 are set longer and shorter, respectively, the meniscus back amount before the ink jetting will increase, and the volume of the ink droplet can decrease. In order to adjust the jetting volume of the small ink droplet, therefore, the widths of the first pulse P11 and second pulse P12 need only be adjusted. Here, the widths of the first and second pulses P11 and P12 are set to be 0.7 AL and 0.3 AL, respectively.

Figure 5:
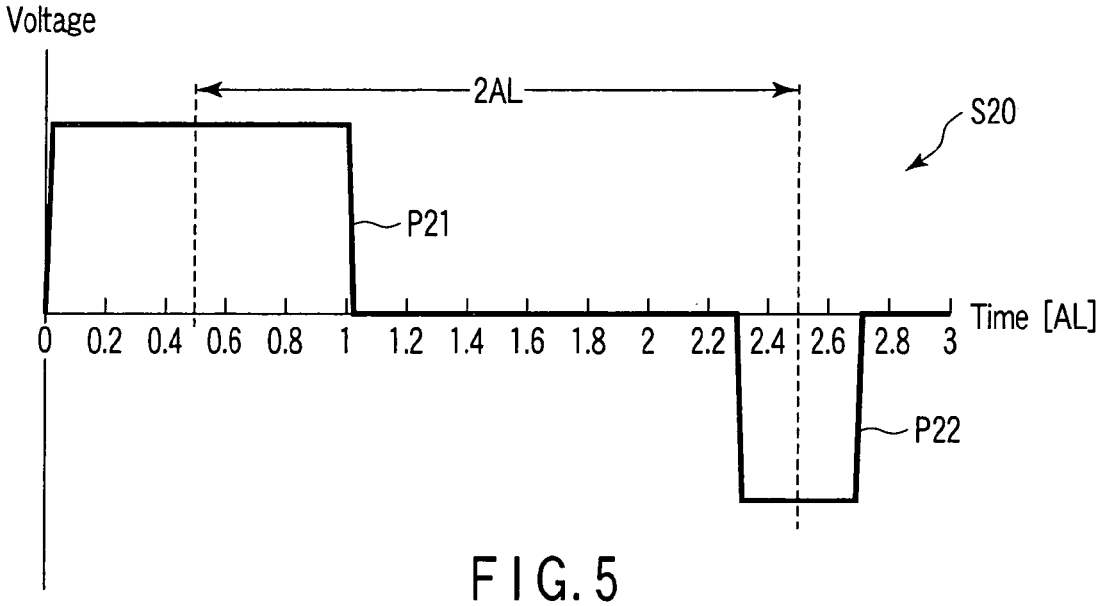
FIG. 5 is a view showing a drive signal waveform for jetting a large ink droplet in the ink jet recording apparatus according to the embodiment.
Figure 6A:
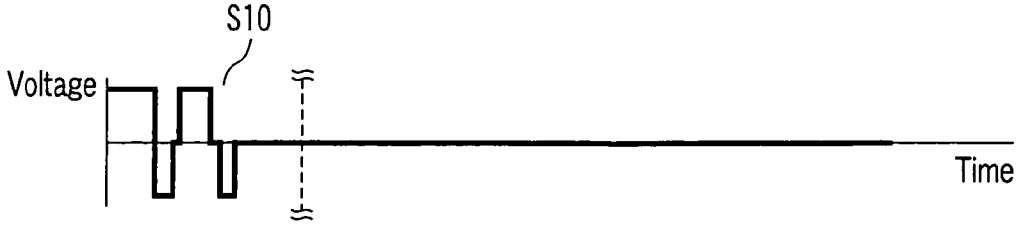
FIG. 6A is a view showing a drive signal of a tone value in the ink jet recording apparatus according to the embodiment.
Figure 6B:
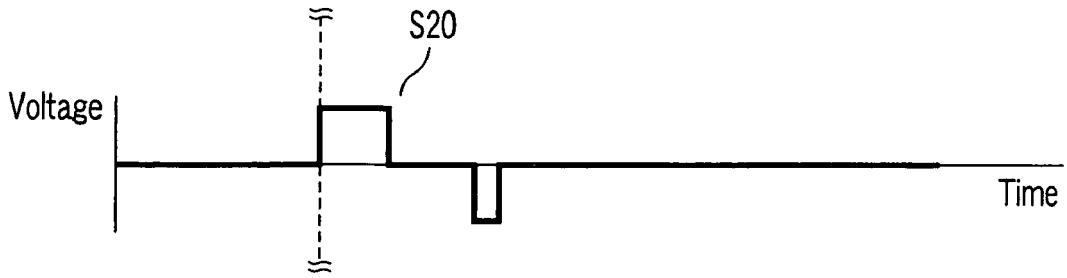
FIG. 6B is a view showing a drive signal of a tone value in the ink jet recording apparatus according to the embodiment.
Figure 6C:
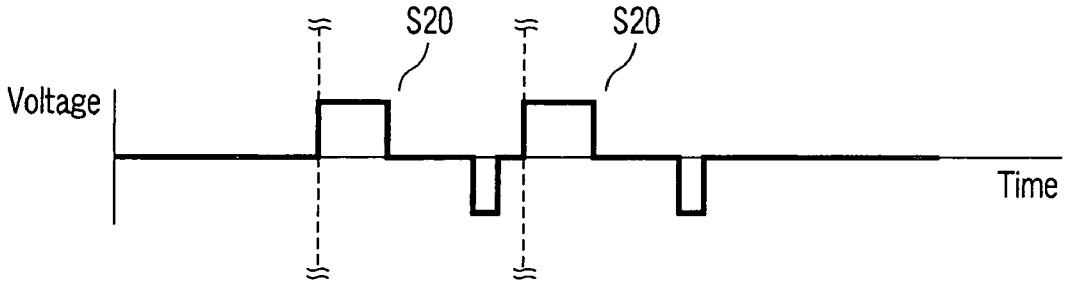
FIG. 6C is a view showing a drive signal of a tone value in the ink jet recording apparatus according to the embodiment.
Figure 6D:
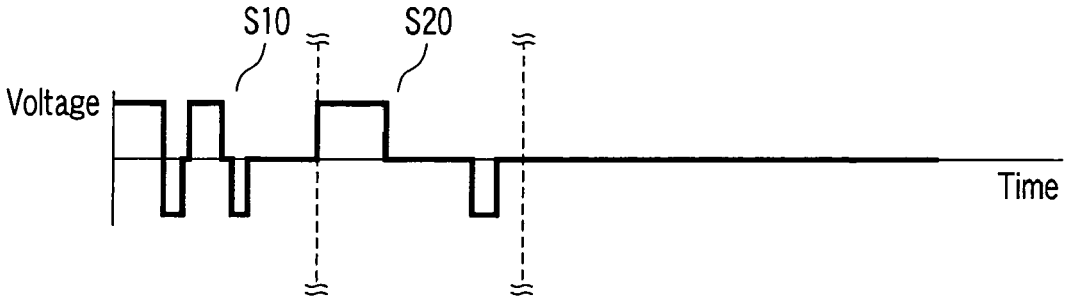
FIG. 6D is a view showing a drive signal of a tone value in the ink jet recording apparatus according to the embodiment.
Figure 6E:
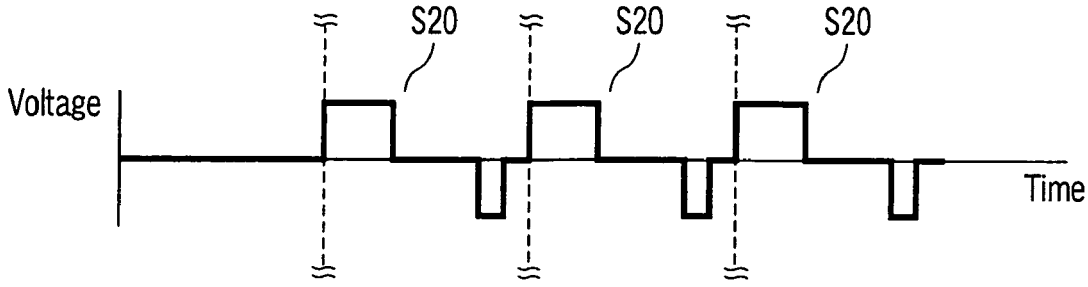
FIG. 6E is a view showing a drive signal of a tone value in the ink jet recording apparatus according to the embodiment.
Figure 6F:
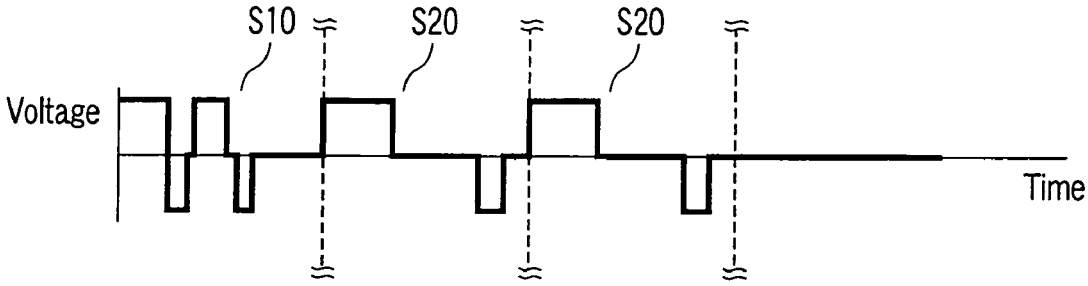
FIG. 6F is a view showing a drive signal of a tone value in the ink jet recording apparatus according to the embodiment.
Figure 6G:
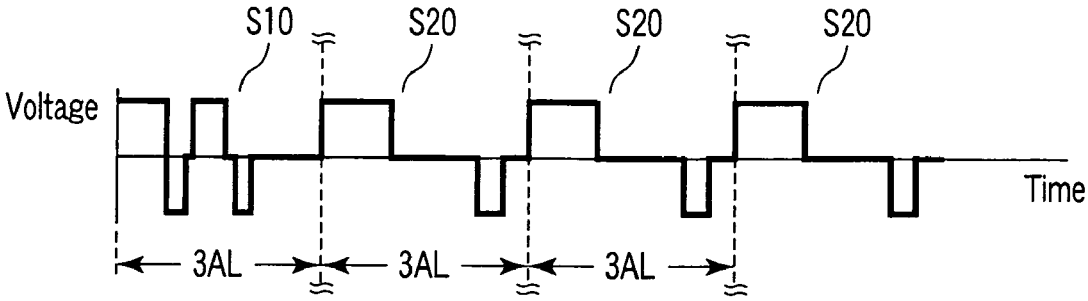
FIG. 6G is a view showing a drive signal of a tone value in the ink jet recording apparatus according to the embodiment.

FIG. 5 shows a waveform of a drive signal S20 for jetting a large ink droplet from the nozzle 9. The drive signal S20 comprises an expand pulse P21 for expanding the volume of the pressure chamber 6 and a compress pulse P22 for compressing the volume of the pressure chamber 6 and one large ink droplet is jetting using these two pulses. The time difference between the center of the width of the expand pulse P21 and the center of the width of the contract pulse P22 is set to 2 AL and the phase of the pressure vibration generated by the expand pulse P21 and the phase of the pressure vibration generated by the compress pulse P22 are set to a mutually opposed state. For this reason, the residual vibration generated by the expand pulse P21 is almost cancelled by the compress pulse P22.

Further, the width of the expand pulse P21 is set to 1 AL and the width of the compress pulse P22 is adjusted based on a damping factor of the residual vibration in the ink in the pressure chamber 6. Here, the width of the compress pulse P22 is set to 0.4 AL. Further, the volume of one large ink droplet jetted by the drive signal S20 is set to almost a double the volume of one small ink droplet jetted by the drive signal S10.

As shown in FIG. 6, the drive signal S10 is set to a first drive timing and the drive signal S20 is set to a subsequent drive timing. Although, in the case of FIG. 6B for example, the drive signal S20 can be set to the same timing as that of the drive signal S10, a timing control circuit for generating a pulse constituting each drive signal becomes complex. Therefore, a drive signal generating means of the present embodiment is so arranged as to allow a drive signal of the same waveform to be output in the same timing.

Generally, there is a tendency that the jetting speed of the small ink droplet becomes slower than that of the large ink droplet. For this reason, the small ink droplet is first jetted and then the large ink droplet is jetted. This allows both the ink droplets to be landed with less variation and assures the obtaining of a better print dot shape. The variation of the ink droplet landing position is not prominent in the case of a slower print speed but becomes prominent in the case of a quicker print speed.

The configurations of the drive signals S10 and S20 are not restricted to those of the present embodiment. Further, the, structure of the ink jet head can be variously changed or modified if there is a requirement of deforming the pressure chamber by the actuator.

According to the present invention there is provided an ink jet recording apparatus which can ensure the monotonic increase of an actual ink jet volume relative to the tone values, obtain a matching between the concentration of print image data and that of an actual print image, fully achieve an enhanced tone representation capability under many-stage tone level control and ensure an excellent print quality.

What is claimed is:

1. An ink jet recording apparatus comprising:

an ink jet head having a pressure chamber with an ink held therein, an ink jet nozzle communicating with the pressure chamber, and an actuator configured to deform the pressure chamber according to a drive signal;

translating means for allowing a tone value corresponding to the concentration of a print pixel to be translated to a pattern which controls the number of times corresponding to the jetting of each of a plurality of kinds of ink droplet sizes, said translating means having a plurality of patterns corresponding to each tone value; and drive signal generating means for generating a drive signal for allowing the pressure chamber to be deformed by the actuator based on the pattern and an ink droplet of said plurality of kinds of ink droplet sizes to be jetted from a corresponding nozzle, wherein, when an assumed jet volume of said pattern is given by the following expression $$\sum_{i=1}^{N} Vi \times Ki$$

where N is the number of kinds of ink droplets; Vi is a jet volume corresponding to the singly jetting of the ink droplet in an i-th number of kinds of ink droplet sizes; and Ki is the number of times corresponding to the jetting of the ink droplet in the i-th number of kinds of ink droplet sizes by the pattern, the concentration of the pixel corresponding to a first tone value is set smaller than the concentration of the pixel corresponding to a second tone value following the first tone value and the assumed jet volume of a pattern corresponding to the first tone value is set greater than the assumed jet volume of a pattern corresponding to the second tone value.

2. An ink jet recording apparatus according to claim 1, wherein the number of the kinds of the ink droplets is 2 and the number of the ink droplet jetted by the pattern corresponding to the first tone value is set equal to the number of the ink droplet jetted by the pattern corresponding to the second tone value.

3. An ink jet recording apparatus according to claim 1, wherein the number of kinds of ink droplets is 2 and the jet volume of a small ink droplet is set almost one half the jet volume of a large ink droplet.

4. An ink jet recording method in which tone recording is made by jetting small and large droplets from an ink jet nozzle of an ink jet head having a pressure chamber with an ink held therein, said ink jet nozzle communicating with the pressure chamber and an actuator configured to deform the pressure chamber according to a drive signal, said method comprising:

applying to said actuator, when such tone recording is made, a first combination drive signal combining together a drive signal for jetting one small ink droplet and at least one large ink droplet following the small ink droplet or a second combination drive signal combining together a plurality of large ink droplets; and setting a tone value corresponding to the first combination drive signal greater than a tone value corresponding to the second combination drive signal, when the same number of jet ink droplets is involved.

5. An ink jet recording apparatus for printing a tone image comprising:

an ink jet head having a pressure chamber with an ink held therein, an ink jet nozzle communicating with the pressure chamber, and an actuator configured to deform the pressure chamber according to a drive signal;

translating means for translating first and second tone values into first and second patterns respectively, each of which corresponds to a concentration of a print pixel and controls the number of times corresponding to the jetting of each of a plurality of kinds of ink droplet sizes; and drive signal generator generating the drive signal for allowing the pressure chamber to be deformed by the actuator based on the pattern selected from the first and second patterns to form the print pixel, wherein, when an assumed jet volume of the selected pattern is given by the following expression $$\sum_{i=1}^{N} Vi \times Ki$$

where N is the number of kinds of ink droplets; Vi is a jet volume corresponding to the singly jetting of the ink droplet in an i-th number of kinds of ink droplet sizes; and Ki is the number of times corresponding to the jetting of the ink droplet in the i-th number of kinds of ink droplet sizes by the selected pattern, the concentration corresponding to the first pattern is set smaller than the concentration corresponding to the second pattern following the first pattern, and the assumed jet volume of the first pattern is set greater than the assumed jet volume of the second pattern.

6. An ink jet recording apparatus according to claim 5, wherein the number of the kinds of the ink droplets is 2 and the number of the ink droplet jetted by the first pattern is set equal to the number of the ink droplet jetted by the second pattern.

7. An ink jet recording apparatus according to claim 5, wherein the number of kinds of ink droplets is 2 and the jet volume of a small ink droplet is set almost one half the jet volume of a large ink droplet.

* * * * *